United States Patent [19]

Jong

[11] Patent Number: 5,060,445

[45] Date of Patent: Oct. 29, 1991

[54] ROOF CONSTRUCTION

[76] Inventor: Slosson B. Jong, 20722 Hunter La., Huntington Beach, Calif. 92646

[21] Appl. No.: 327,795

[22] Filed: Mar. 23, 1989

[51] Int. Cl.[5] ..... E04D 1/00

[52] U.S. Cl. ..... 52/553; 52/542; 52/552

[58] Field of Search ..... 52/537, 538, 542, 549, 52/551, 552, 553, 533

[56] References Cited

U.S. PATENT DOCUMENTS

| | | | |
|---|---|---|---|
| 2,038,192 | 4/1936 | Overbury | 52/553 X |
| 2,080,671 | 5/1937 | Overbury | 52/542 |
| 2,143,166 | 1/1939 | Pattiani | 52/553 |
| 3,245,187 | 4/1966 | May | 52/552 X |
| 4,765,113 | 8/1988 | Jong . | |

FOREIGN PATENT DOCUMENTS

| | | | |
|---|---|---|---|
| 969248 | 5/1950 | France | 52/553 |

OTHER PUBLICATIONS

"Sierra Tile" Brochure for Western Sierra Roofing Company Brochure of Cal-Pac Roofing, Inc.

"Alcoa" Advertising Sheet Hardishake Literature.

"Gerard Tile Inc." Advertising Sheet Trend Tile Literature.

*Primary Examiner*—Richard E. Chilcot, Jr.

*Assistant Examiner*—Creighton Smith

*Attorney, Agent, or Firm*—William P. Green

[57] ABSTRACT

A roof structure formed of overlapping rows of tiles retained in place by elongated generally horizontally extending members each of which extends along and is vertically between upper edge portions of the tiles in a first row of tiles and lower edge portions of the tiles in a second row. The tiles of the two rows preferably have flanges which are secured to opposite edges of the member. The tiles and the mentioned retaining members are secured in position by attachment to a series of parallel base boards forming a part of the substructure of the roof assembly. The tiles are strengthened at their side edges by reinforcing plates received beneath the tiles and each projecting laterally into overlapping relation with two adjacent tiles, with these elements also assisting in preventing flow of water downwardly between the side edges of adjacent tiles.

32 Claims, 3 Drawing Sheets

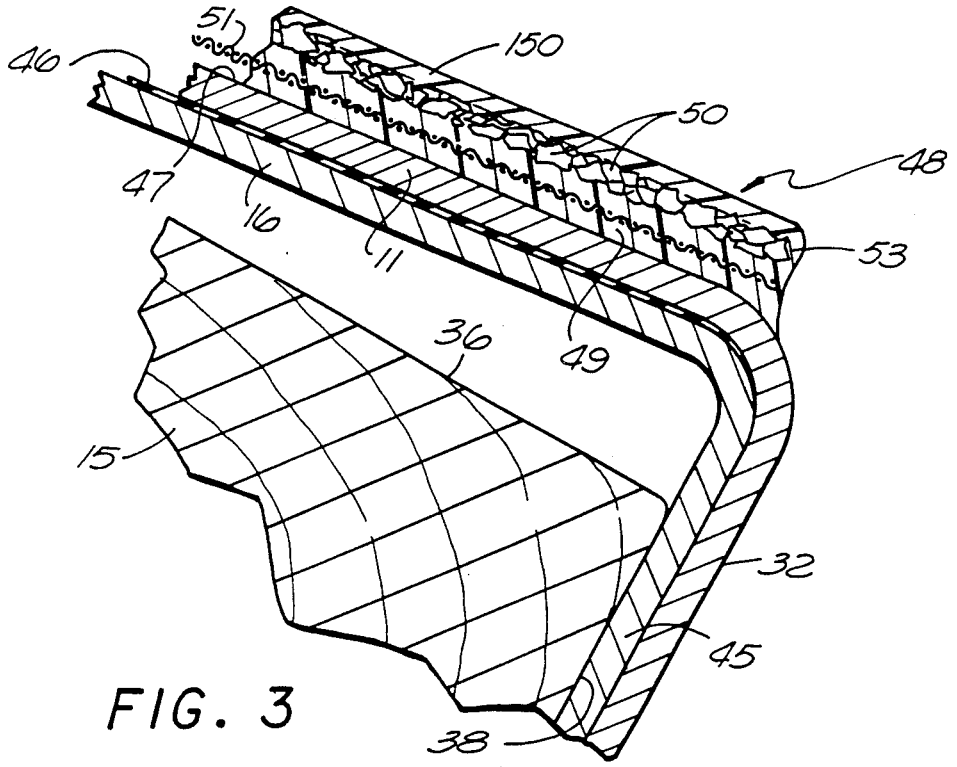
FIG. 3
FIG. 4
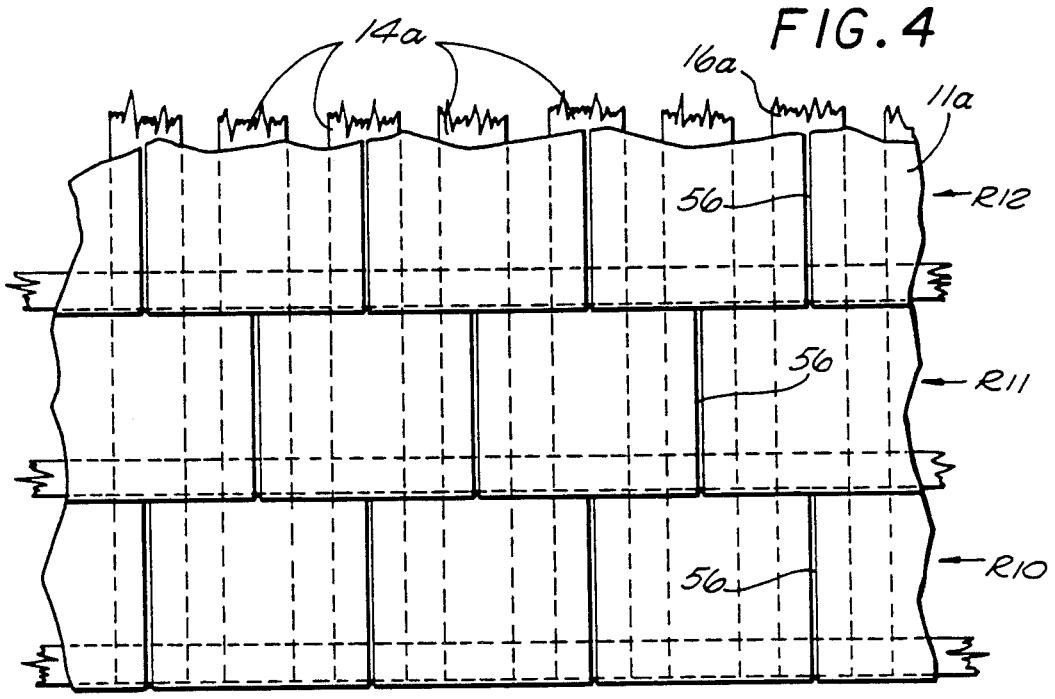

ROOF CONSTRUCTION

This invention relates to an improved type of roof structure and to methods of forming such a structure.

BACKGROUND OF THE INVENTION

In recent years, building codes in many areas have become increasingly more rigid in requiring that roofs of homes or other buildings be resistant to fire. One way of satisfying this requirement is by treating wooden shingles or shakes with chemicals intended to be fire resistive. Another approach is to utilize shingles or tiles formed of a material other than wood and which is fire resistant. For example, tiles stamped from sheet metal may be utilized. However, such metal roofs as previously designed and as currently available have been more difficult to assemble on a building than would be desired, with resultant excessive overall cost of the completed roof. Much of the difficulty has been caused by the necessity in most instances for attaching to the roof substructure a rather complex grid of intersecting boards as a base to which the metal tiles can ultimately be nailed.

SUMMARY OF THE INVENTION

A major purpose of the present invention is to provide a roof structure which can be essentially permanent, highly fire resistant and watertight, and which achieves all of these purposes with simple structural components easily assembled at minimum cost. The roof is formed of tiles arranged in a shingle type pattern and which are preferably formed of metal and coated with a decorative and fire resistant material.

Retention of the tiles in position on the roof substructure is attained in a highly effective but simple manner by a series of elongated tie-down members, typically boards of nominal one inch by two inch cross-section, which extend horizontally along overlapping edges of successive rows of such tiles. Each such member is received above an upper edge portion of a tile or tiles in a first row, and beneath lower edge portions of a tile or tiles in the next successive row. The tie-down member is nailed to the roof substructure, and acts to secure the associated rows of tiles thereto. The member is thus received between two overlapping edges of tiles of successive rows, and locates those tiles in permanently fixed position on the roof, while the member itself is covered by one of the tiles and not visible from the exterior of the roof. Preferably, each of the tiles has an upturned flange at its upper edge and a downturned flange at its lower edge, with each of the elongated members being received between two such flanges of adjacent tiles and being secured thereto.

To facilitate attachment of the tiles to the substructure, that structure may include a series of base boards extending upwardly at an inclination toward the top of the roof. The horizontally elongated tie-down members may then be nailed to these base boards. In addition, the tiles may be supported and sealed along their side edges by strengthening plates received beneath those edges in horizontally overlapping relation and appropriately nailed to the roof substructure. Beneath the parallel base boards, the substructure may include sheeting of plywood or the like covered by a waterproof asphalt treated paper ("tar paper").

BRIEF DESCRIPTION OF THE DRAWINGS

The above and other features and objects of the invention will be better understood from the following detailed description of the typical embodiments illustrated in the accompanying drawings in which:

FIG. 3 is an enlarged detail view corresponding to a portion of FIG. 2; and FIG. 4 is a reduced fragmentary elevational view similar to FIG. 1, but showing a variational arrangement in which the tiles of successive rows are staggered with respect to one another.

DESCRIPTION OF THE PREFERRED EMBODIMENTS

Figure 1:
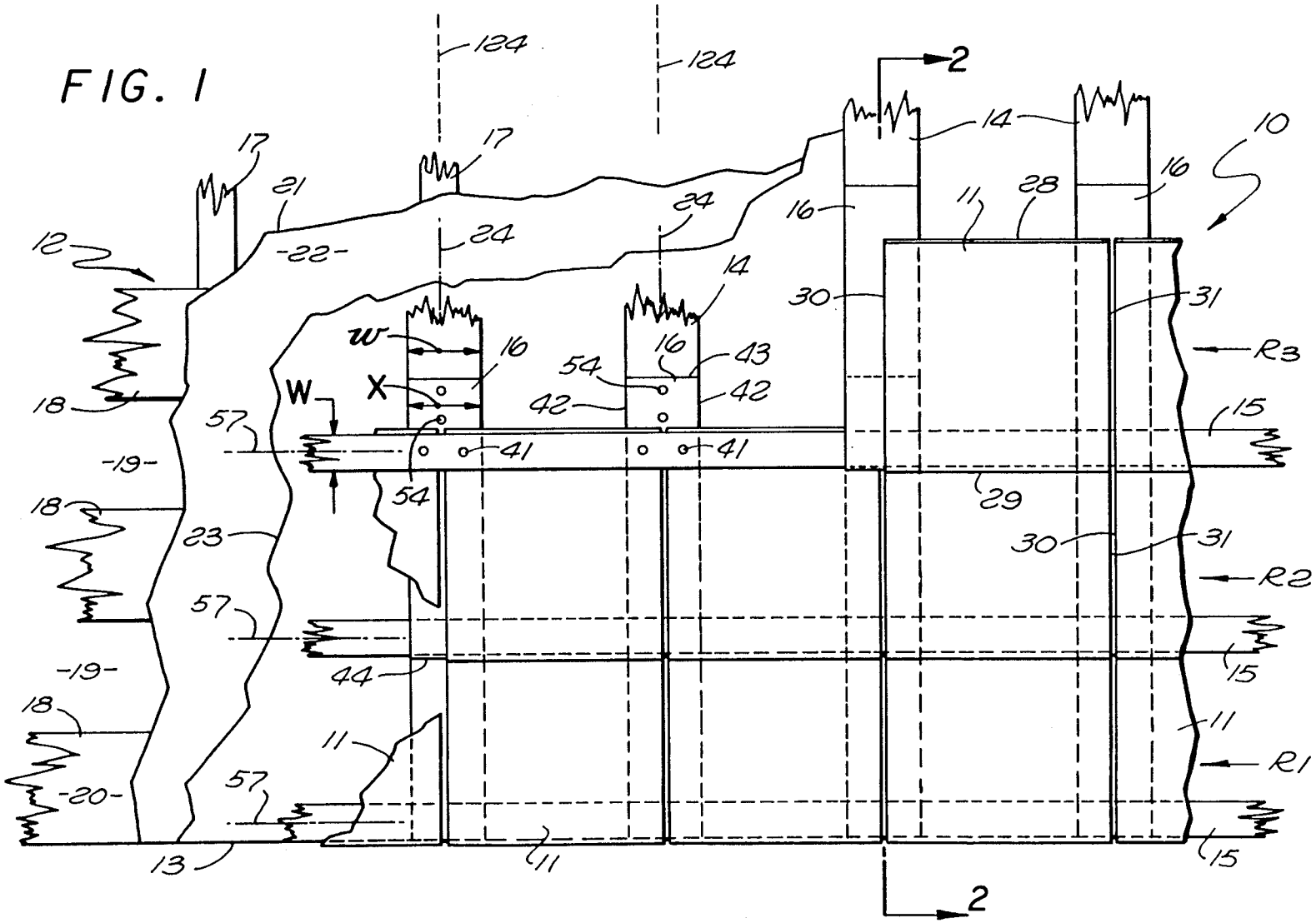
FIG. 1 is a fragmentary top elevational view of a roof embodying the invention.
Figure 2:
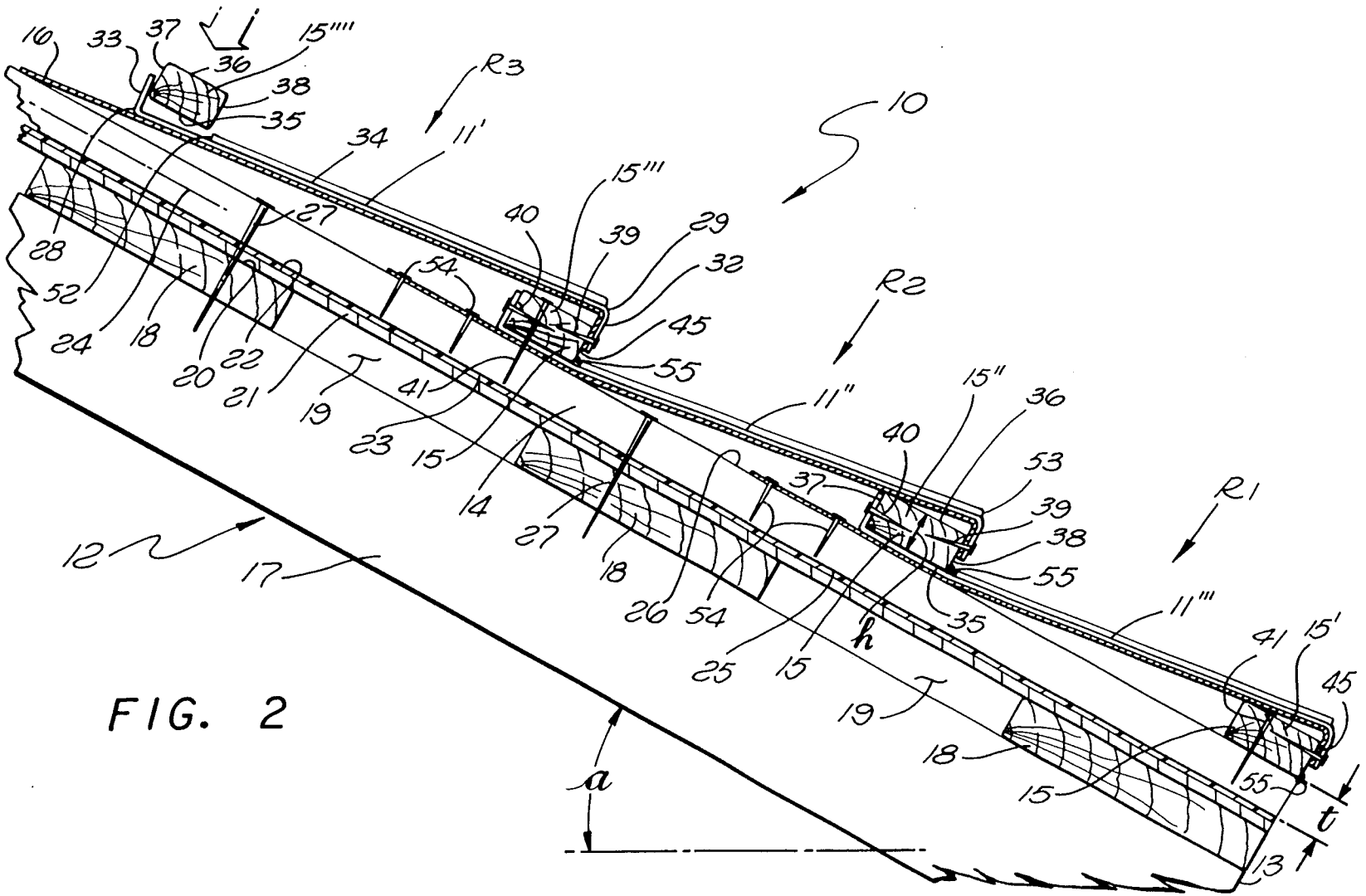
FIG. 2 is an enlarged fragmentary vertical section taken on line 2—2 of FIG. 1.

The roof 10 illustrated in FIGS. 1 and 2 includes a number of identical sheet metal tiles 11 attached to an inclined roof substructure 12 and arranged on that substructure in horizontally extending rows R1, R2, R3, etc., up to the number of rows required to completely cover the substructure from its lower eave edge 13 to the peak of the roof. The tiles may be retained on the substructure by a series of parallel inclined boards 14 extending upwardly and downwardly at an inclination along the upper surface of the substructure, and by a series of horizontally extending parallel boards 15 acting as tie-down elements for securing the tiles to boards 14. The tiles are strengthened and sealed along their side edges by metal supporting straps 16.

As seen in FIG. 2, the substructure 12 of the roof may include conventional rafters 17 extending parallel to one another from the lower edge of the roof to its upper edge and inclined at an angle a with respect to the horizontal. Attached to the upper sides of the rafters are a series of conventional purlins or sheathing boards 18, elongated horizontally and extending parallel to one another and typically of nominal one inch by six inch cross-section. In the usual roof substructure, these boards 18 are spaced apart to leave elongated gaps 19 between the boards. The upper surfaces 20 of sheathing boards 18 lie in a common plane disposed at the inclination angle a with respect to the horizontal.

In a roof structure constructed in accordance with the invention, the substructure of the roof preferably includes also a thin layer 21 of plywood or other similar sheet material, nailed or otherwise secured to the upper surfaces 20 of boards 18 and extending across the entire area of the roof. This plywood may typically be one-fourth inch or three-eighths of an inch in thickness, and presents an upper inclined surface 22 which is planar and disposed at the inclination of angle a. Extending along the upper surface of the plywood layer 21, the roof assembly includes a sheet or sheets 23 of asphalt impregnated paper, which are nailed to the plywood and to boards 18, and which may be sealed at the locations of the nails and along the edges of overlapping sheets of the tar paper, to provide a continuous waterproof layer covering the entire area of the roof and positively preventing leakage of any water downwardly through that layer. The plywood sheets 21 and boards 14 and 15 are preferably all pretreated with an insect and fire resistance chemical, desirably sodium pentachlorophene.

After the plywood and the asphalt sheets 23 have been nailed in place, the boards 14 are next attached to the roof. These boards are elongated and extend along parallel axes 24 inclined at the same slope angle a as the other portions of the roof to extend parallel to the upper surface of plywood layer 21 and to asphalt sheets 23. It will also be apparent that the longitudinal axes 24 of boards 14 are perpendicular to the lower edge 13 of the roof and to the peak of the roof (not shown), and lie in spaced parallel vertical planes represented at 124 in FIG. 1. Boards 14 have planar undersurfaces 25 engaging the asphalt paper, and have planar upper surfaces 26 lying in a common plane and disposed at the slope angle of the roof. The cross section of each board 14 transversely of its longitudinal axis 24 may typically be nominally one inch by four inches, with the smaller of those dimensions being the thickness dimension t represented in FIG. 2, and with the greater dimension being the width w as seen in FIG. 1. Boards 14 are secured to boards 18 by nails represented at 27 in FIG. 2.

Each of the tiles 11 is preferably cut and stamped from sheet metal, desirably twenty six gauge steel, and may be square in outline configuration as viewed in FIG. 1. More particularly, each tile may have a higher or top edge 28, a lower or bottom edge 29, and two opposite side edges 30 and 31. Edges 28 and 29 are parallel to one another and extend horizontally in the assembled condition of the roof, while side edges 30 and 31 are perpendicular to edges 28 and 29 and parallel to one another and extend upwardly along the roof at an inclination. The left edge 30 of each of the tiles is received closely adjacent and extends parallel to the right edge 31 of the next successive tile in the same row.

With regard now to FIG. 2, each of the tiles 11 initially has the vertical sectional configuration of the tile shown at 11' in FIG. 2. After the tile has been nailed to the roof, it assumes the slightly changed configuration of the tiles 11'' and 11''' in FIG. 2. To describe the initial shape 11' in greater detail, the sheet metal of the tile in that condition is shaped to form a flange 32 along the lower edge portion 29 of the tile, and a second flange 33 along the upper edge 28 of the tile. The portion 34 of the tile between flanges 32 and 33 is initially completely flat and planar over its entire area between the various edges of the tile. Flange 32 extends essentially perpendicular to portion 34 of the tile, and projects downwardly toward the substructure and essentially perpendicular to the plane of upper surfaces 26 of boards 14. The second flange 33 at the upper edge of the tile is also essentially perpendicular to the main portion 34 of the tile but projects upwardly away from the substructure essentially perpendicular to surfaces 26 of boards 14. It will also be understood that each of the flanges 32 and 33 is itself essentially planar across its entire area, and is disposed essentially perpendicular to the axes 24 and vertical planes 124.

The bottom edge flange 32 of each tile overlaps or extends beyond the upper edge flange 33 of the next lower tile, with a corresponding one of the horizontal tie-down boards 15 received between the flanges in an interfitting relation (FIG. 2) and secured to the flanges to rigidly retain the tiles in their illustrated positions. Boards 15 are elongated horizontally along parallel axes 57 which are perpendicular to axes 24 of boards 14 and to the vertical planes 124. Boards 15 are of uniform cross-section transversely of their length, with that cross-section preferably being nominally one inch by two inches. The shorter of these dimensions is the height h perpendicular to upper surfaces 26 of boards 14, and the larger of the two transverse dimensions of boards 15 is the width W. As seen in FIG. 2, the planar undersurfaces 35 and upper surfaces 36 of boards 15 are parallel to one another and inclined to be parallel to upper surfaces 26 of boards 14. Planar edge surfaces 37 and 38 of boards 15 are parallel to one another and perpendicular to surfaces 35, 36 and 26. In the assembled roof, flange 33 of one of the tiles is received adjacent and parallel to surface 37 of one of the boards 15, and is secured thereto by nails 40 driven through flange 33 and into the board 15. The flange 32 of a next upper tile 11 is parallel to and received adjacent the surface 38 of the same board 15, and is secured thereto by nails 39 driven through the flange and into the board. Boards 15 are attached rigidly to the substructure by nails 41 driven downwardly through boards 15 and through the metal of the tiles and into boards 14. As each board is thus secured in place, the driving of the nails acts to bend the underlying portion of each of the tiles 11 from the condition of the tile 11' in FIG. 2 to the condition of the tiles 11'' and 11''' in that figure. As will be noted, each of the tiles 11'' and 11''' has been bent slightly at the lower edge of a corresponding member 15 so that the portion of the sheet metal tiles vertically between each board 15 and the corresponding board 14 is directly parallel to and clamped between surfaces 26 and 35.

The strengthening and sealing straps 16 are stamped of sheet metal, preferably of the same twenty six gauge steel as tiles 11. Each of the straps 16 overlies one of the boards 41 and may have a width x corresponding to the width w of boards 14. Each strap may be considered as defined by two parallel opposite side edges 42, a transverse upper edge 43, and a lower edge 44. At that lower edge, the sheet material of strap 16 may be turned downwardly toward surface 26 to form a flange 45 projecting toward surface 26 of the corresponding board 14 in the assembled condition of the elements. This flange 45 is parallel to flange 32 at the lower edge of one of the tiles, and after assembly is received between that flange and surface 38 of one of the boards 15. The nails 39 are driven through both of the flanges and into board 15 to secure the flanges tightly to the board. Except at the location of downturned flange 45, each metal strap 16 is initially flat from that flange to its upper edge 43 (see upper end of FIG. 2). When the nails 41 are driven downwardly through one of the boards 15 and a corresponding tile 11, those nails are also driven through the underlying portion of one of the straps 16, to bend the strap into parallelism with surfaces 26 and 35 in correspondence with the previously discussed bending of the upper edge portion of the tile. Thus, the straps 16 are deformed to their ultimate shape and locked in position by the same boards 15 which hold the tiles in place. As will be apparent from FIG. 1, each of the straps 16 projects laterally beneath an edge portion of each of two adjacent tiles near their side edges 30 and 31, to add the strength of the strap to that of the tiles in assuring effective and permanent support of the tiles at their edges. Also, the straps 16 in extending across the gaps between adjacent side edges 30 and 31 of the tiles form closures preventing the flow of water downwardly through those gaps. To enhance this water sealing action, the upper surfaces of the straps 16 are preferably coated with a sealant such as asphalt for contacting the undersurfaces of the tiles and forming a continuous watertight seal between the strap and each of the tiles along the entire length of each of the side edges 30 and 31 of the tiles. This asphalt seal between straps 16 and the tiles is represented at 46 in FIG. 3.

For appearance and/or improved fire resisting characteristics, the upper surfaces 47 of the metal tiles are preferably coated with a layer 48 of material adhered tightly to the tiles and having both decorative and heat insulative qualities. This layer 48 desirably includes a coating 49 of an adhesive substance with particles 50 of sand, glass 'smaltz', rock or other materials of low heat conductivity distributed across and adhered to the upper surface of the adhesive and covered with a layer 150 of sodium silicate. The adhesive material 49 preferably consists of a mixture of portland cement and an acrylic adhesive intermixed and allowed to cure in place on the tiles. The mixture of these components may typically be about ten parts of fine portland cement to one part of acrylic, by weight. Also, there is desirably embedded within the adhesive 49 a layer of preferably metal mesh 51, extending across the entire area of the layer 48 and tightly bonded thereto by curing of the adhesive material. This layer of mesh may be formed of expanded metal or woven wire mesh or the like, and acts to resist breakage or cracking of the layer 48 in handling of the tile or under forces encountered after the roof is completed. As seen in FIG. 2, the decorative and heat insulative layer 48 terminates upwardly at an edge 52 which is received closely adjacent board 15 in the assembled condition of the roof; and terminates downwardly at an edge 53 just short of the downturned flange 32 so that the layer 48 does not cover the flange. If desired, the adhesive material 49 of layer 48 may be asphalt.

To now describe the process which is followed in assembling the roof of FIGS. 1 and 2 on the roof substructure, assume that plywood layer 21 and the asphalt paper 23 have been attached to boards 18. The next step is to nail the base boards 14 in place on top of the asphalt paper and parallel to one another, with these boards extending upwardly along the inclined roof from its lower edge to its upper edge. The person installing the roof then attaches a first of the transverse tie-down boards 15 to the lower edge of the roof at the position of the particular board identified by the number 15' in FIG. 2. Next, the tiles 11''' of the first row R1 and the straps 16 underlying the edges of those tiles are moved into position, and the lower flanges 32 and 45 of those tiles and straps are secured to the first horizontal board 15' by nails driven through the flanges and into the board. The upper ends of the straps 16 are nailed to boards 14 at 54. Seals may be formed between board 15' and the boards 14 by application of mastic at 55 between these boards along the entire width of each of the boards 14.

Along the upper edges of the first row R1 of tiles, the second of the horizontal tie-down members (15'' in FIG. 2) is moved into position adjacent the upwardly turned upper flanges 33 of the tiles, and that board 15'' is secured in place by driving nails 41 downwardly through the board and through the tiles and straps 16 into boards 14. Also, flanges 33 are at this point secured to board 15'' by nails 40. Thereafter, the tiles 11'' of the next row R2 of tiles, and the corresponding underlying straps 16 of that row, are moved into position as seen in FIG. 2, with the lower flanges 32 and 45 of these tiles and straps being nailed to tie down strip 15'', and with the upper ends of the straps 16 being nailed to boards 14. The third of the boards 15 (identified as 15''' in FIG. 2) is then nailed in place, and the flanges of the tiles R2 and R3 are secured thereto by nails extending through the flanges and into the board, after which the next successive horizontal tie-down board 15'''' is moved into place and the process is repeated as many times as necessary to complete the entire roof. At the lower edge of each of the boards 15, mastic 55 is applied in correspondence with the discussion of the application of such mastic to the lowermost of these boards. As each of the straps 16 is moved into place, its upper surface may be coated with tar, asphalt or another sealant as represented at 46 in FIG. 3, to form the discussed seals against leakage of water along the side edges of the tiles.

FIG. 4 illustrates an arrangement which may be identical with that of FIGS. 1 and 2 except that the tiles **11*a* of successive horizontal rows of tiles are staggered horizontally relative to one another. For example, the tiles 11*a* of the first row R10 of FIG. 4 may be located in positions corresponding exactly to the positions of the tiles of row R1 of FIG. 1. However, the tiles of the next successive row R11 of FIG. 4 are offset horizontally so that the side edges 56 of the tiles of row R11 are located midway between the side edges 56 of the tiles of row R10. The tiles of the next successive row R12 have their edges 56 aligned with the edges of the first row R10. This pattern is continued through the entire area of the roof. In order to accomodate this staggered pattern, there must be twice as many boards 14*a* in the FIG. 4 arrangement as in the FIG. arrangement, to allow attachment of all of the tiles and the associated straps 16*a* to the members 14*a***.

It is contemplated that if desired a roof embodying the present invention may be applied over an old roof already in place on the building. This can reduce the overall cost considerably in view of the very substantial cost which is involved in removing an old roof. The plywood sheets may be placed directly on top of the old roof and nailed thereto, after which the asphalt paper and other components shown in the drawings are attached to the plywood as discussed.

While certain specific embodiments of the present invention have been disclosed as typical, the invention is of course not limited to these particular forms, but rather is applicable broadly to all such variations as fall within the scope of the appended claims.

I claim:

1. The method of covering a building with a series of tiles arranged in rows on a support structure, with each tile having two side edges and having generally horizontally extending top and bottom edges, comprising:

positioning a first tile of a first of said rows on said support structure;

thereafter securing an elongated member in a generally horizontally extending position on said first tile near said top edge thereof; and then securing a second tile in a second of the rows in a position overlapping said first tile and with said member received between a portion of the first tile near said top edge thereof and a portion of said second tile near said bottom edge thereof.

2. The method as recited in claim 1, in which said first and second tiles are both secured to said member.

3. The method as recited in claim 1, in which said member is secured in said generally horizontally extending position by driving a fastener or fasteners through said member and through said first tile and into said structure.

4. The method as recited in claim 1, including providing as a portion of said structure a series of elongated boards extending upwardly at an inclination generally parallel to one another, said elongated member being secured in said generally horizontally extending position by attaching said member to said boards.

5. The method as recited in claim 1, in which one of said first and second tiles has a main portion and an edge flange projecting generally perpendicular to said main portion and extending along an edge of said elongated member.

6. The method as recited in claim 5, including driving fasteners through said flange and into said member to secure them together.

7. The method as recited in claim 1, in which said first tile has a flange turned to project upwardly away from said support structure, and said second tile has a flange turned to project downwardly toward said structure, said method including positioning said elongated member between said flanges of the first and second tiles.

8. The method as recited in claim 7, including driving fasteners through each of said flanges and into said member to secure said first and second tiles to the member.

9. The method as recited in claim 1, including positioning an element to extend along and project beneath a side edge portion of said first tile and beneath an adjacent side edge portion of an adjacent third tile.

10. The method as recited in claim 9, including providing a layer of a sealant material between said element and adjacent surfaces of said first and third tiles to form a seal therebetween.

11. The method as recited in claim 9, including securing said element to said support structure at a location upwardly beyond said elongated member and beyond said top edges of said first and third tiles.

12. The method of forming a roof comprising: attaching a series of base boards to an inclined structure with said base boards extending at an inclination upwardly along the structure essentially parallel to one another;

positioning on said base boards a first row of tiles, with each tile having two side edges and having a generally horizontally extending top edge with an upwardly turned flange and a generally horizontally extending bottom edge with a downwardly turned flange;

securing an elongated member in a generally horizontally extending position above tiles of said first row near said upwardly turned flanges thereof; and securing in overlapping relation with the tiles of said first row a second row of similar tiles each having two side edges and having a top edge with an upwardly turned flange and having a bottom edge with a downwardly turned flange, with said elongated generally horizontally extending member received between said upwardly turned flanges of said tiles of the first row and said downwardly turned flanges of said tiles of the second row, and received vertically between adjacent portions of said tiles of the first and second rows.

13. The method as recited in claim 12, in which said tiles of said first and second rows and said member are secured in position on said structure by driving fasteners through said member and said tiles of the first row and into said base boards, and driving fasteners through said upwardly turned flanges of said tiles of the first row and said downwardly turned flanges of said tiles of the second row and into said member.

14. The method as recited in claim 13, including locating an additional elongated member between said upwardly turned flanges of said tiles of the second row and said downwardly turned flanges of tiles of a third row and vertically between adjacent portions of said tiles of the second and third rows, driving fasteners through said additional elongated member into said base boards, and driving fasteners through said upwardly turned flanges of said tiles of the second row and said downwardly turned flanges of said tiles of the third row and into said additional elongated member.

15. The method as recited in claim 14, including locating strengthening plates extending along the side edges of adjacent tiles in each of said rows, with each plate projecting beneath adjacent side edges of two adjacent tiles.

16. The method as recited in claim 15, including attaching each of said plates to one of said base boards at a location upwardly beyond a corresponding one of said elongated members.

17. The method as recited in claim 12, including positioning reinforcing plates extending along the side edges of adjacent tiles in each of said rows, with the individual plates projecting beneath adjacent edge portions of two adjacent tiles.

18. A covering for a building comprising:

a series of tiles arranged in rows on a support structure, with each tile having two side edges and having generally horizontally extending top and bottom edges;

an elongated member extending generally horizontally on a first of said tiles in a first of said rows and at a location near said top edge of said first tile;

a second of the tiles in a second of the rows being positioned to overlap said first tile and said member, with said member received between a portion of the first tile near said top edge thereof and a portion of said second tile near said bottom edge thereof;

said first tile having a flange turned to project away from said support structure;

said second tile having a flange turned to project toward said structure;

said elongated member being received between said flanges of said first and second tiles; and fasteners driven through each of said flanges and into said elongated member to secure said first and second tiles to the member.

19. A covering for a building as recited in claim 18, including an element extending along and projecting beneath a side edge portion of said first tile and beneath an adjacent side edge portion of an adjacent third tile.

20. A covering for a building as recited in claim 18, including reinforcing plates extending along the side edges of adjacent tiles in each of said rows, with the individual plates projecting beneath adjacent edge portions of two adjacent tiles.

21. A covering for a building comprising:

a series of tiles arranged in rows on a support structure, with each tile having two side edges and having generally horizontally extending top and bottom edges;

an elongated member extending generally horizontally on a first of said tiles in a first of said rows and at a location near said top edge of said first tile;

a second of the tiles in a second of the rows being positioned to overlap said first tile and said member, with said member received between a portion of the first tile near said top edge thereof and a portion of said second tile near said bottom edge thereof;

an element extending along and projecting beneath a side edge portion of said first tile and beneath an adjacent side edge portion of an adjacent third tile; and fastener means attaching said element to said inclined structure at a location upwardly beyond said elongated member and beyond said top edges of said first and third tiles.

22. A covering for a building as recited in claim 21, in which said first and second tiles are both secured to said elongated member.

23. A covering for a building as recited in claim 21, including fastener means driven through said member and through said first tile and into said structure to secure said member and said first tile thereto.

24. A covering for a building as recited in claim 21, in which said inclined structure includes a series of elongated boards extending upwardly at an inclination generally parallel to one another and to which said tiles and said elongated member are attached.

25. A covering for a building as recited in claim 21, in which one of said first and second tiles has a main portion and an edge flange projecting generally perpendicular to said main portion and extending along an edge of said elongated member.

26. A covering for a building as recited in claim 25, including fastener means driven through said flange and into said elongated member to secure them together.

27. A covering for a building as recited in claim 21, in which said first tile has a flange turned to project away from said support structure, and said second tile has a flange turned to project toward said structure, and said elongated member is received between said flanges of said first and second tiles.

28. A covering for a building as recited in claim 21, including a layer of a sealant material between said element and adjacent surfaces of said first and third tiles to form a seal therebetween.

29. A roof comprising:

an inclined structure;

a series of base boards attached to said inclined structure with said base boards extending at an inclination upwardly along the structure essentially parallel to one another;

a first row of tiles, with each tile having two side edges and having a generally horizontally extending top edge with an upwardly turned flange and a generally horizontally extending bottom edge with a downwardly turned flange;

an elongated member extending generally horizontally above the tiles of said first row near said upwardly turned flange thereof;

a second row of tiles overlapping said first row and each having two side edges and having a top edge with an upwardly turned flange and a bottom edge with a downwardly turned flange, with said elongated generally horizontally extending member received between said upwardly turned flanges of said tiles of the first row and said downwardly turned flanges of said tiles of the second row, and received vertically between adjacent portions of said tiles of the first and second rows;

fasteners driven through said member and said tiles of the first row and into said base boards; and fasteners driven through said upwardly turned flanges of said tiles of the first row and said downwardly turned flanges of said tiles of the second row and into said member.

30. A roof as recited in claim 29, including a third row of tiles each having two side edges and having a generally horizontally extending top edge with an upwardly turned flange and a generally horizontally extending bottom edge with a downwardly turned flange, and an additional elongated member between said upwardly turned flanges of said tiles of the second row and said downwardly turned flanges of said tiles of the third row and vertically between adjacent portions of said tiles of the second and third rows, fasteners driven through said additional elongated member and said tiles of the second row into said base boards, and fasteners driven through said upwardly turned flanges of said tiles of the second row and said downwardly turned flanges of said tiles of the third row and into said additional elongated member.

31. A roof as recited in claim 30, including strengthening plates extending along the side edges of adjacent tiles in each of said rows, with each plate projecting beneath adjacent side edges of two adjacent tiles.

32. A roof as recited in claim 31, including fastener means attaching each of said plates to one of said base boards at a location upwardly beyond a corresponding one of said elongated members.

* * * * *